US012612799B1

(12) United States Patent
Zhu et al.

(10) Patent No.: US 12,612,799 B1
(45) Date of Patent: Apr. 28, 2026

(54) CENTRAL LOCKING MECHANISM FOR FOLDING TENT, NOVEL CENTRAL LOCKING MECHANISM AND FOLDING TENT

(71) Applicant: Zhejiang Yotrio Group Co., Ltd., Linhai (CN)

(72) Inventors: Faling Zhu, Linhai (CN); Linyong Sun, Linhai (CN); Jianqiang Xie, Linhai (CN)

(73) Assignee: Zhejiang Yotrio Group Co., Ltd., Linhai (CN)

( * ) Notice: Subject to any disclaimer, the term of this patent is extended or adjusted under 35 U.S.C. 154(b) by 206 days.

(21) Appl. No.: 18/560,258

(22) PCT Filed: Sep. 6, 2023

(86) PCT No.: PCT/CN2023/117135
§ 371 (c)(1),
(2) Date: Nov. 10, 2023

(87) PCT Pub. No.: WO2024/109254
PCT Pub. Date: May 30, 2024

(30) Foreign Application Priority Data

Nov. 22, 2022 (CN) ..... 202223092901.7

(51) Int. Cl.
*E04H 15/50* (2006.01)

(52) U.S. Cl.
CPC ..... *E04H 15/50* (2013.01)

(58) Field of Classification Search
CPC ..... E04H 15/50
(Continued)

(56) References Cited

U.S. PATENT DOCUMENTS 6,336,465 B1 * 1/2002 Surrendi ..... E04H 15/28 135/147
9,995,056 B2 * 6/2018 Yang ..... E04H 15/50
(Continued)

FOREIGN PATENT DOCUMENTS

CA 3220783 A1 * 5/2024
CN 202611329 U * 12/2012
(Continued)

OTHER PUBLICATIONS

Translation of CN 2021259627U which is CN 212927306U (on the IDS dated Dec. 8, 2025).*
(Continued)

*Primary Examiner* — Robert Canfield
(74) *Attorney, Agent, or Firm* — Ziegler IP Law Group, LLC.

(57) ABSTRACT

The present invention discloses a central locking mechanism for a folding tent, novel central locking mechanism and folding tent, the folding tent including a tent roof frame and a central locking mechanism disposed on the tent roof frame; the central locking mechanism includes an upper disk and a lower disk; a lock bar is cooperatively disposed on the lower disk; a lock slot is disposed at a lower part of the upper disk; an upper end of the lock bar is fastened in the lock slot to complete locking, wherein the positions of the lock bar and the lock slot are exchangeable. The present invention optimizes the structure of the central locking mechanism, may realize push-up self-locking and pull-down unlocking by means of the fastening cooperation of the lock bar and the lock slot, thus facilitating locking and unlocking operations. In addition, the lock bar and the lock slot have simple structures; especially, the upper disk and the lock slot may be integrally injection-molded, thus reducing the manufacturing cost of the product.

18 Claims, 11 Drawing Sheets

(58) Field of Classification Search
USPC ..... 135/131, 135, 145, 159
See application file for complete search history.

(56) References Cited

U.S. PATENT DOCUMENTS

| | | | | |
|---|---|---|---|---|
| 10,273,710 | B2 * | 4/2019 | Yang | E05B 65/00 |
| 10,941,585 | B2 * | 3/2021 | Sun | E04H 15/50 |
| 10,982,464 | B2 * | 4/2021 | Ying | E04H 15/44 |
| 11,085,201 | B2 * | 8/2021 | Sun | E04H 15/50 |
| 11,299,906 | B2 * | 4/2022 | Yang | E04H 15/52 |
| 12,270,218 | B2 * | 4/2025 | Qiu | E04H 15/18 |
| 2010/0319743 | A1 * | 12/2010 | Zhou | E04H 15/28 135/135 |
| 2018/0209167 | A1 * | 7/2018 | Yang | E04H 15/48 |
| 2018/0238075 | A1 * | 8/2018 | Yang | E04H 15/44 |
| 2018/0298631 | A1 * | 10/2018 | Yang | E04H 15/50 |
| 2019/0234102 | A1 * | 8/2019 | Lu | E04H 15/50 |
| 2019/0277053 | A1 * | 9/2019 | Yang | E04H 15/52 |
| 2019/0368232 | A1 * | 12/2019 | Sun | E04H 15/50 |
| 2020/0181939 | A1 * | 6/2020 | Ying | E04H 15/34 |
| 2020/0240167 | A1 * | 7/2020 | Sun | E04H 15/48 |
| 2020/0347635 | A1 * | 11/2020 | Sun | E04H 15/50 |
| 2025/0129635 | A1 * | 4/2025 | Zhang | E05B 65/52 |
| 2025/0215723 | A1 * | 7/2025 | Yuan | E04H 15/60 |

FOREIGN PATENT DOCUMENTS

| | | | | | |
|---|---|---|---|---|---|
| CN | 110593639 | A | * | 12/2019 | E04H 15/00 |
| CN | 210264139 | U | | 4/2020 | |
| CN | 111287548 | A | | 6/2020 | |
| CN | 211286916 | U | * | 8/2020 | E04H 15/32 |
| CN | 211572859 | U | * | 9/2020 | E04H 15/48 |
| CN | 212927306 | U | | 4/2021 | |
| CN | 217205727 | U | | 8/2022 | |
| JP | 2017160784 | A | | 9/2017 | |

OTHER PUBLICATIONS

Translation of Written Opinion mailed Jan. 3, 2024 in PCT/CN2023/117135.*

* cited by examiner

CENTRAL LOCKING MECHANISM FOR FOLDING TENT, NOVEL CENTRAL LOCKING MECHANISM AND FOLDING TENT

FIELD OF TECHNOLOGY

The present invention relates to the technical field of outdoor tents, and more particularly to a central locking mechanism for a folding tent, novel central locking mechanism and folding tent.

BACKGROUND

With the constant improvement of the living condition of people, tents are used more and more frequently. Tents are generally divided into folding tents and fixed tents, wherein the folding tent has a wide application market owing to convenient storage and transportation. The alias of the folding tent is an advertising tent and an awning. The folding tent can be used for outdoor exhibitions and product promotion, celebration evenings, exhibitions, tourism, leisure, field work, and food stalls. The folding tent can also be used for song and dance evenings and other temporary activities, as well as long-term leisure facilities in a park tourist resort scenic area. The folding tent is simple to operate, and easy to mount.

The folding tent generally includes a foldable tent frame and a tarpaulin, wherein the tent frame consists of a tent roof frame, four or more support legs; the support legs are used to support the tent roof frame; a locking structure is disposed on the support leg; the tarpaulin covers the tent roof frame, and is used for shading, rain and wind sheltering. At present, the locking structure is generally a locking pin, and the tent is locked in an unfolded state by locking each support leg respectively. Therefore, the folding and unfolding of the tent needs the cooperation of multiple people, and the operation is bothersome.

In order to solve the problem, the patent No. CN111287548' discloses a tent, including support legs and an inner extension and retraction unit, wherein the inner extension and retraction unit includes a first inclined top pipe and a first connecting rod hinged to the first inclined top pipe; the tent further includes a central lock including a central rod, a central top cap fixed at one end of the central rod, and a central bottom cap detachably connected to the other end of the central rod; the support legs are connected to the central lock by means of the inner extension and retraction unit; the first inclined top pipe is hinged to the central top cap of the central lock, and the first connecting rod is hinged to the central bottom cap of the central lock; a locking member is received in the central bottom cap; a first through hole allowing the central rod to penetrate through is disposed in the locking member; a clamping portion is disposed at one end of the central rod; when the central lock is in a locked state, an upper end surface of the clamping portion presses against a lower end surface of the locking member; when the central lock is in an unlocked state, the clamping portion can penetrate through the first through hole; the present invention provides a tent including a central lock which can support the entire tent and distribute the force uniformly on the tent.

The above structure adopts a central locking structure design. However, the central locking structure is relatively complex, especially the under carriage structure thereof, and therefore the manufacturing cost is high.

SUMMARY

In order to solve the above problems, the objective of the present invention is to provide a central locking mechanism for a folding tent, novel central locking mechanism and folding tent. The present invention simplifies the structure of the central locking mechanism, adopts the structure of push-up self-locking and pull-down unlocking, facilitates operations, and has a simple structure and a low manufacturing cost.

The technical problems to be solved by the present invention may be implemented by adopting the following technical solutions:

A central locking mechanism for a folding tent, the folding tent including a tent roof frame and a central locking mechanism disposed on the tent roof frame; the central locking mechanism includes an upper disk and a lower disk; a lock bar is cooperatively disposed on the lower disk; a lock slot is disposed at a lower part of the upper disk; an upper end of the lock bar is fastened in the lock slot to complete locking; the lock bar includes a bar body and a lock head located at an upper end of the bar body; a lower end of the bar body is fixedly cooperated with the lower disk; the lock head is fixedly mounted at the upper end of the bar body; the lock head is fastened in the lock slot to complete locking; the lock head includes a guide cone head, a limit post, and a limit ring platform; the guide cone head is completely fastened in the lock slot; and the limit ring platform is in limit cooperation with a port of the lock slot.

The lock head and the lock bar are of an integrated structure.

The lock head further includes an embedded portion; the embedded portion is located at a lower part of the limit ring platform, and is fixedly cooperated with the upper end of the bar body.

The guide cone head includes a guide cone portion, a detent portion, and an inverted cone portion; a lock slot chamber is disposed in the lock slot; the lock slot chamber sequentially includes a cone head accommodation chamber, a lock ring opening, and an opening flaring chamber from top to bottom; an inner diameter size of the lock ring opening is less than an outer diameter size of the detent portion; and when the central locking mechanism is in a locked state, the guide cone head is located in the cone head accommodation chamber.

When the folding tent changes from a folded state to an unfolded state, the lower disk gradually gets close to the upper disk, and the guide cone head gradually move upwards from the opening flaring chamber, such that the lock ring opening deforms and extends outwards to penetrate through the detent portion, and the lock ring opening retracts and limits the inverted cone portion.

The lock slot includes at least two locking plates; the locking plates mutually form a lock slot chamber; an elastic slot is disposed between two adjacent locking plates; and a clamping platform is disposed on an inner wall of the locking plate.

The lock ring opening is formed on a horizontal plane on which the clamping platform is located; an opening flaring portion is disposed at a lower part of the clamping platform; the elastic slot is an isosceles trapezoid; an upper end surface of the elastic slot is smaller than a lower end surface.

The number of the locking plates is three, four, five, or six.

In another embodiment, further provided is a novel central locking mechanism for a folding tent, the folding tent including a tent roof frame and a central locking mechanism disposed on the tent roof frame; the central locking mechanism includes an upper disk and a lower disk; the positions of a lock bar and a lock slot are exchangeable; the lock bar is located in the upper disk, and is disposed downwards; the lock slot is located in the lower disk, and is disposed with an opening upwards; a lower end of the lock bar is fastened in the lock slot to complete locking; the lock bar includes a bar body and a lock head located at a lower end of the bar body; an upper end of the bar body is fixedly cooperated with the upper disk; the lock head is fixedly mounted at the lower end of the bar body; the lock head is fastened in the lock slot to complete locking; the lock head includes a guide cone head, a limit post, and a limit ring platform; the guide cone head is completely fastened in the lock slot; and the limit ring platform is in limit cooperation with a port of the lock slot.

The lock head and the lock bar are of an integrated structure.

The lock head further includes an embedded portion; the embedded portion is located at an upper part of the limit ring platform, and is fixedly cooperated with the lower end of the bar body.

The guide cone head includes a guide cone portion, a detent portion, and an inverted cone portion; a lock slot chamber is disposed in the lock slot; the lock slot chamber sequentially includes a cone head accommodation chamber, a lock ring opening, and an opening flaring chamber from bottom to top; an inner diameter size of the lock ring opening is less than an outer diameter size of the detent portion; and when the central locking mechanism is in a locked state, the guide cone head is located in the cone head accommodation chamber.

When the folding tent changes from a folded state to an unfolded state, the lower disk gradually gets close to the upper disk, and the guide cone head gradually move downwards from the opening flaring chamber, such that the lock ring opening deforms and extends outwards to penetrate through the detent portion, and the lock ring opening retracts and limits the inverted cone portion.

The lock slot includes at least two locking plates; the locking plates mutually form a lock slot chamber; an elastic slot is disposed between two adjacent locking plates; and a clamping platform is disposed on an inner wall of the locking plate.

The lock ring opening is formed on a horizontal plane on which the clamping platform is located; an opening flaring portion is disposed at a lower part of the clamping platform; the elastic slot is an isosceles trapezoid; an upper end surface of the elastic slot is larger than a lower end surface.

The number of the locking plates is three, four, five, or six.

A folding tent, including any one of the above central locking mechanisms.

Compared with the prior art, the present invention has the following beneficial effects: The present invention optimizes the structure of the central locking mechanism, may realize push-up self-locking and pull-down unlocking by means of the fastening cooperation of the lock bar and the lock slot, thus facilitating locking and unlocking operations. In addition, the lock bar and the lock slot have simple structures; the structures may exchange use functions; especially, the upper disk or the lower disk and the lock slot may be integrally injection-molded, thus reducing the manufacturing cost of the product.

The features of the present invention can be clearly understood with reference to the drawings and the detailed description of the following preferred embodiments.

DESCRIPTION OF THE EMBODIMENTS

In order to easily understand the technical means, creative features, objectives, and effects achieved by the present invention, the present invention will be further described below with reference to specific drawings.

Embodiment 1

Figure 1:
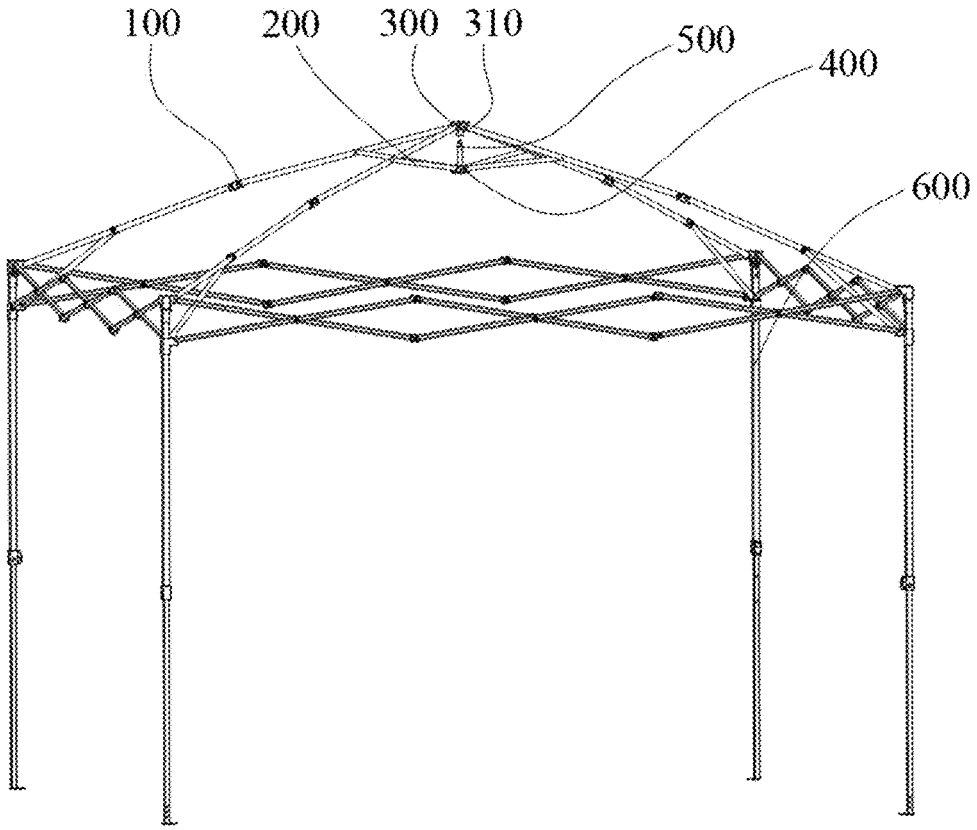
FIG. 1 is a first schematic view of an overall structure of the present invention.
Figure 2:
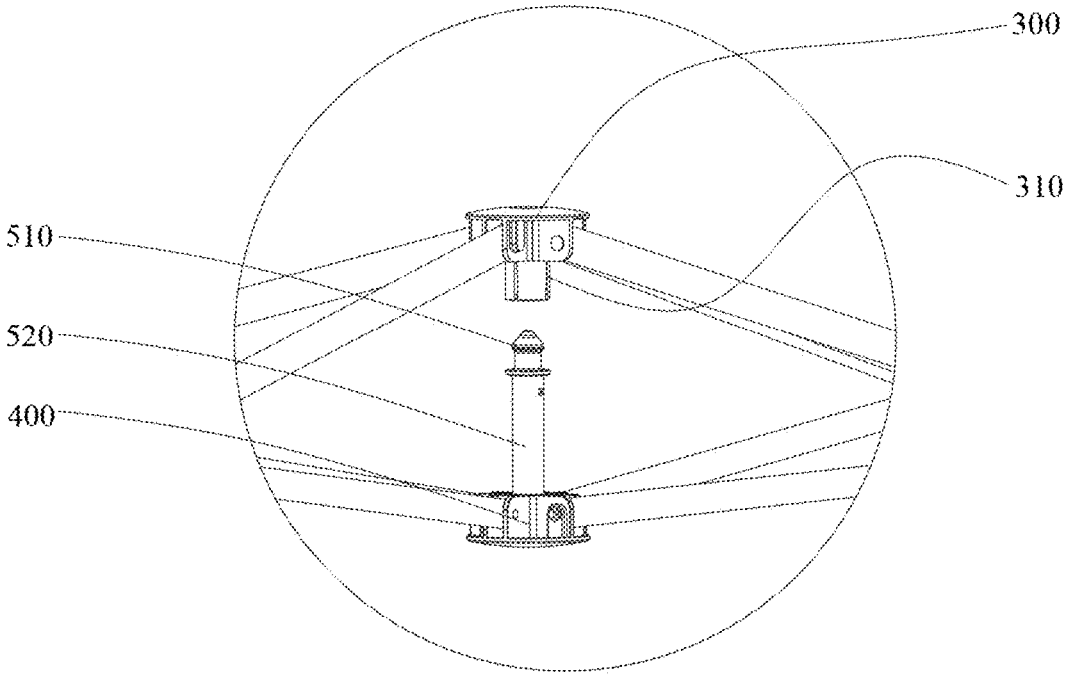
FIG. 2 is a first structural schematic view of a central locking mechanism in an unlocked state according to the present invention.
Figure 3:
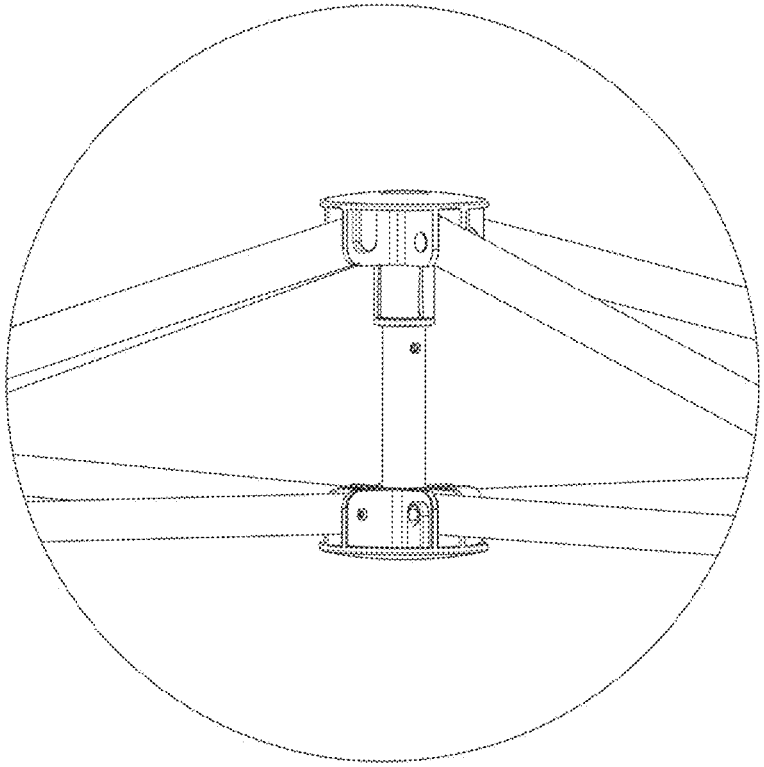
FIG. 3 is a first structural schematic view of the central locking mechanism in a locked state according to the present invention.
Figure 4:
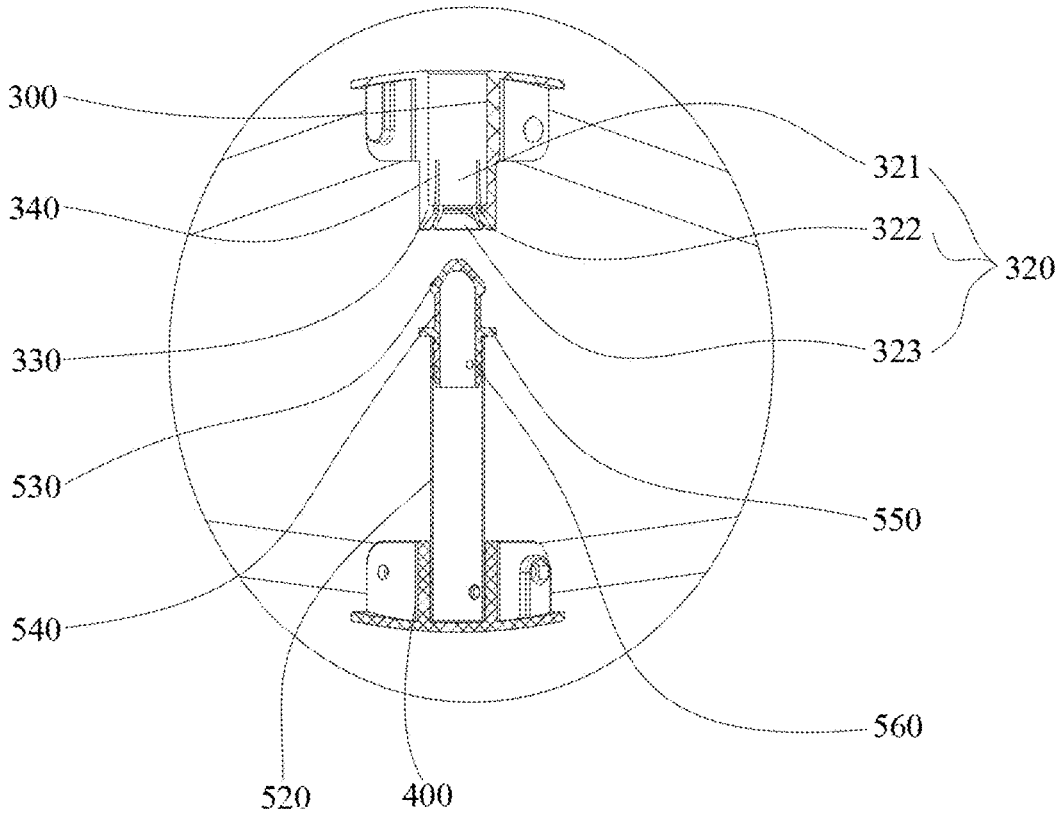
FIG. 4 is a first sectional structural schematic view of the central locking mechanism in the unlocked state according to the present invention.
Figure 5:
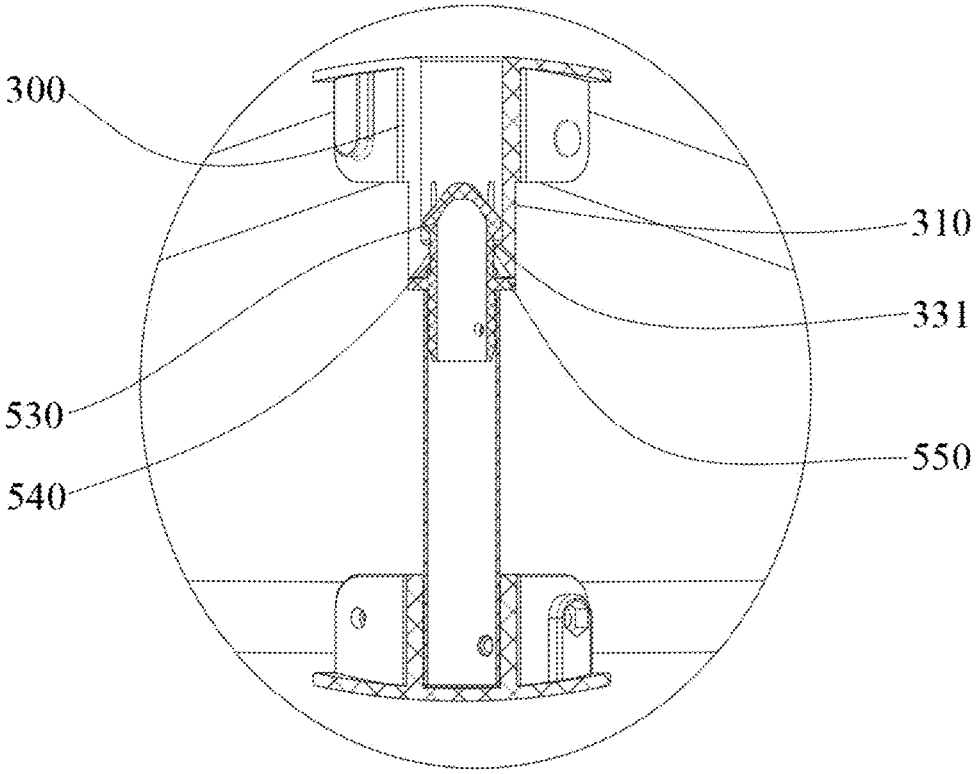
FIG. 5 is a first sectional structural schematic view of the central locking mechanism in the locked state according to the present invention.
Figure 6:
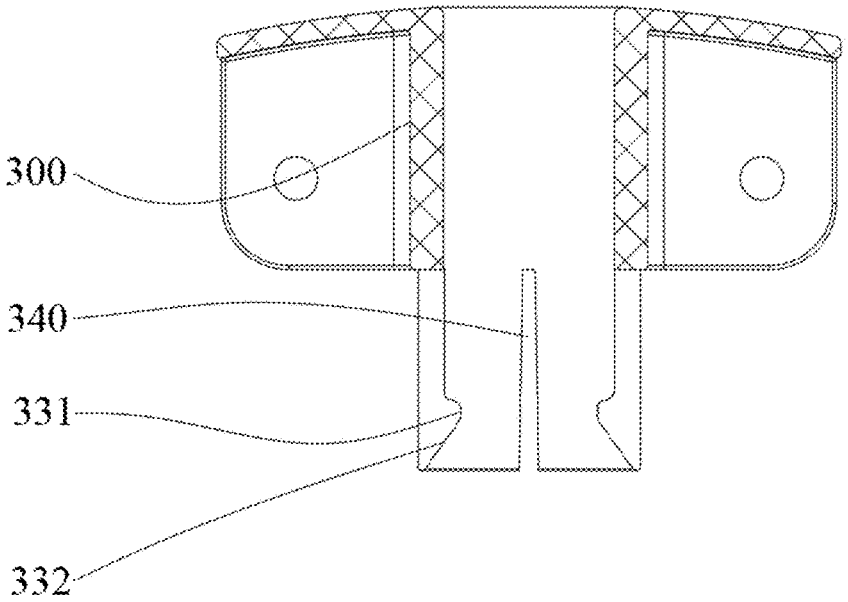
FIG. 6 is a sectional structural schematic view of an upper disk according to the present invention.
Figure 7:
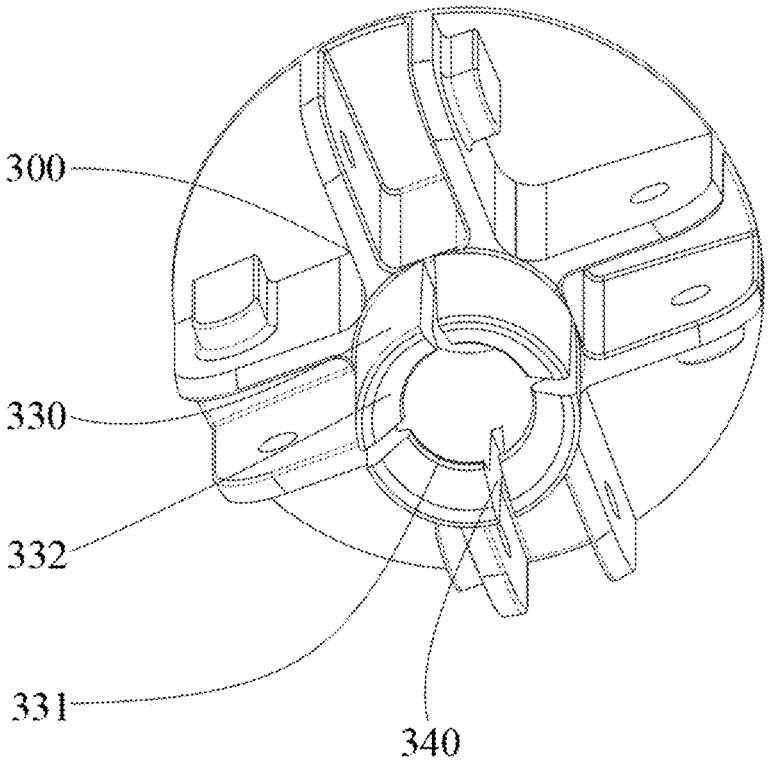
FIG. 7 is a first schematic view of an overall structure of the upper disk according to the present invention.
Figure 8:
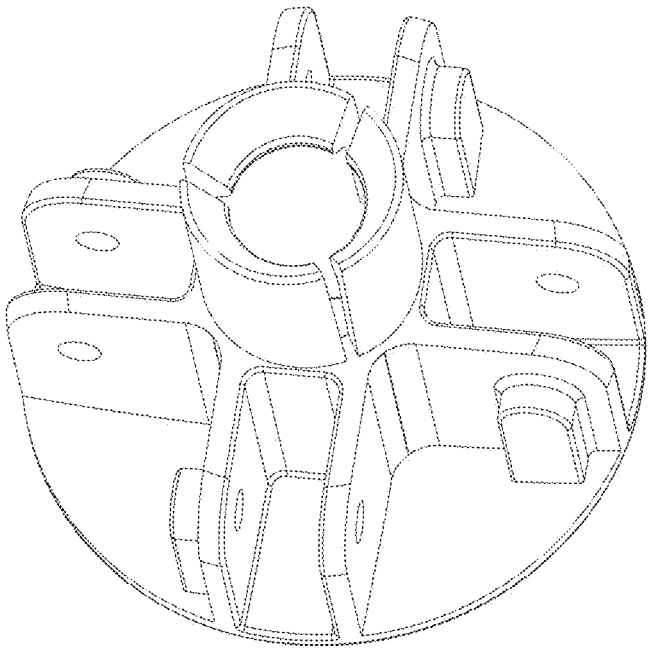
FIG. 8 is a second schematic view of an overall structure of the upper disk according to the present invention.
Figure 9:
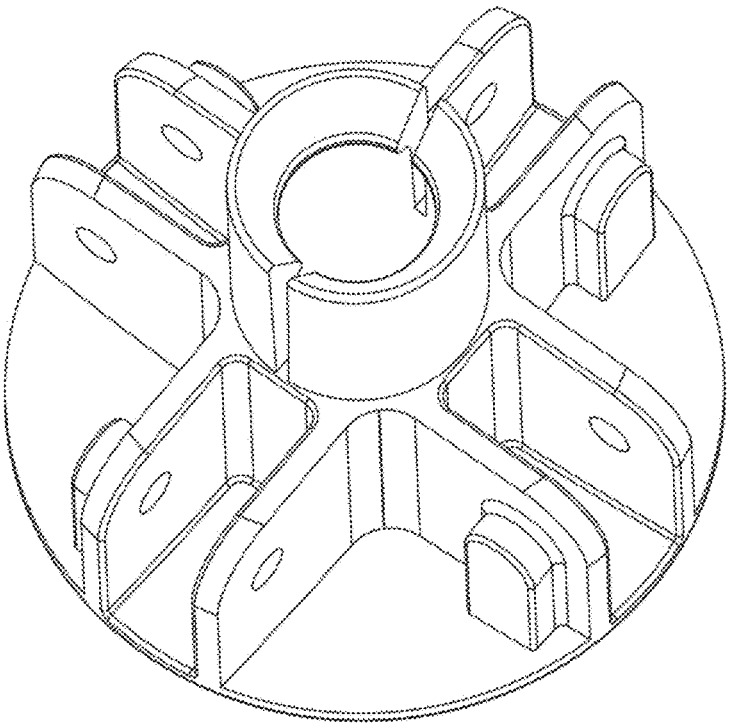
FIG. 9 is a third schematic view of an overall structure of the upper disk according to the present invention.
Figure 10:
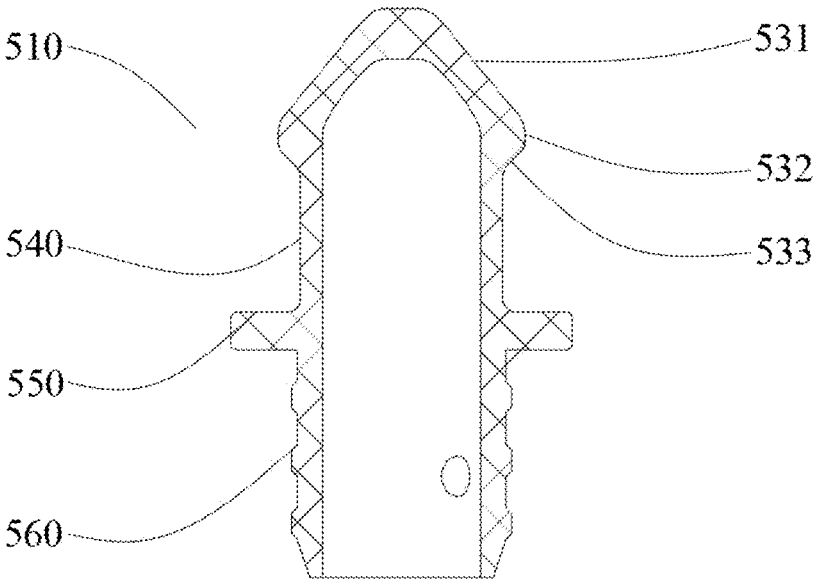
FIG. 10 is a first sectional structural schematic view of a lock head according to the present invention.
Figure 11:
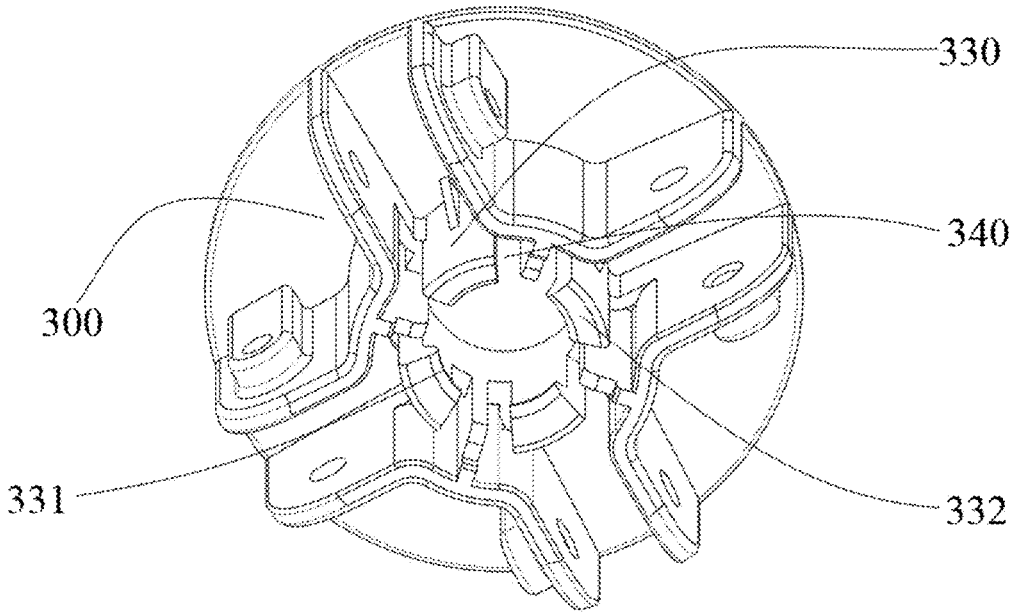
FIG. 11 is a fourth schematic view of an overall structure of the upper disk according to the present invention.
Figure 12:
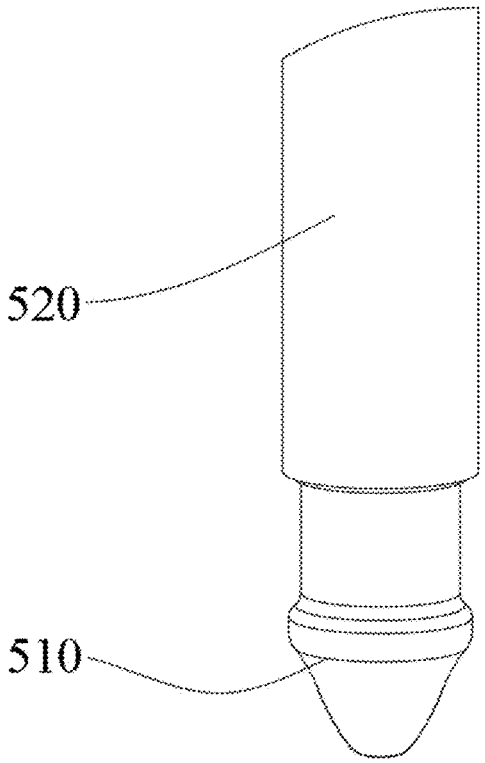
FIG. 12 is a schematic view of an integrated structure of a bar body and the lock head according to the present invention.

As shown in FIGS. 1-11, the present embodiment discloses a central locking mechanism for a folding tent, the folding tent including a tent roof frame and a central locking mechanism disposed on the tent roof frame; the central locking mechanism includes an upper disk 300 and a lower disk 400; the upper disk 300 is cooperatively hinged to a plurality of long tent ribs 100; the other ends of the long tent ribs 100 are cooperatively hinged to a leg pipe 600; one long tent rib 100 generally consists of a plurality of cooperatively hinged tent ribs; a plurality of short tent ribs 200 are cooperatively disposed on the lower disk 400; and the other ends of the short tent ribs 200 are cooperatively hinged to the long tent ribs 100. In the entire central locking mechanism, the lower disk 400 and the upper disk 300 movably cooperate; and the short tent ribs 200 support and drive the long tent ribs 100, so as to unfold and fold the entire folding tent.

Preferably, a lock bar 500 is cooperatively disposed on the lower disk 400; a lock slot 310 is disposed at a lower part of the upper disk 300; and an upper end of the lock bar 500 is fastened in the lock slot 310 to complete locking. Preferably, the lock bar 500 includes a bar body 520 and a lock head 510 located at an upper end of the bar body 520; a lower end of the bar body 520 is fixedly cooperated with the lower disk 400; the lock head 510 is fixedly mounted at the upper end of the bar body 520; the lock head 510 is fastened in the lock slot 310 to complete locking.

In combination with the above description, in the present embodiment, the structure of the lock head is optimized; the fastening structure of the lock head 510 and the lock slot 310 may be used to lock and limit the upper disk 300 and the lower disk 400, thus facilitating the locking of the unfolded folding tent.

Preferably, the lock head 510 includes a guide cone head 530, a limit post 540, and a limit ring platform 550; the guide cone head 530 is completely fastened in the lock slot 310; and the limit ring platform 550 is in limit cooperation with a port of the lock slot 310. The guide cone head 530 includes a guide cone portion 531, a detent portion 532, and an inverted cone portion 533; a lock slot chamber 320 is disposed in the lock slot 310; the lock slot chamber 320 sequentially includes a cone head accommodation chamber 321, a lock ring opening 322, and an opening flaring chamber 323 from top to bottom; an inner diameter size of the lock ring opening 322 is less than an outer diameter size of the detent portion 532; and when the central locking mechanism is in a locked state, the guide cone head 530 is located in the cone head accommodation chamber 321.

In specific use, when the folding tent changes from a folded state to an unfolded state, the lower disk 400 gradually gets close to the upper disk 300, the guide cone head 530 gradually moves upwards from the opening flaring chamber 323, and a conical surface of the guide cone head 530 presses against an inner wall of the opening flaring chamber 323; after the lower disk 400 persistently moves upwards, the inner wall of the opening flaring chamber 323 is constantly squeezed by the conical surface of the guide cone head 530, and then persistently deforms, so as to drive the upper lock ring opening 322 to deform and extend outwards. The structure of the guide cone head 530 is optimized; the structural design of a conical wall is adopted to achieve a guide effect; when the guide cone head 530 moves upwards with the lower disk 400, the guide cone head presses against the lock ring opening 322; with the persistent upward movement of the guide cone head 530, the lock ring opening 322 also persistently extends outwards, until the detent portion 532 presses against the lock ring opening 322, and forcedly passes through the lock ring opening 322, so as to penetrate through the detent portion 532; the lock ring opening 322 is not pressed by an external force, and therefore retracts; and the limit post 540 is filled in the lock ring opening 322. Preferably, when no external force is applied to the lock ring opening 322, the inner diameter size is the same as or slightly greater than the outer diameter size of the limit post 540; the inverted cone portion 533 is in a transition region between the limit post 540 and the detent portion 532; the retracted lock ring opening 322 limits the inverted cone portion 533; the design of the inverted cone portion is optimized, facilitating the outward extension and disengagement of the lock ring opening 322 during unlocking.

In combination with the above description, in one embodiment, the lock head 510 and the lock bar 520 are of an integrated structure, namely are integrally formed.

In combination with the above description, in one embodiment, the lock head 510 and the lock bar 520 adopt a split fixed structure, wherein the lock head 510 further includes an embedded portion 560; the embedded portion 560 is located at a lower part of the limit ring platform 550, and is fixedly cooperated with the upper end of the bar body 520; the lock head 510 adopts a detachable structure, wherein the lock head 510 is preferably made from a plastic material; the bar body 520 is preferably made from a metal material; the lock head 510 is integrally formed by means of injection molding, thus simplifying the components and reducing the cost.

In combination with the above description, preferably, the lock slot 310 includes at least two locking plates 330; the locking plates 330 mutually form a lock slot chamber 320; an elastic slot 340 is disposed between two adjacent locking plates 330; the elastic slot 340 is an isosceles trapezoid; an upper end surface of the elastic slot 340 is smaller than a lower end surface; in another equivalent embodiment, the elastic slot 340 may have a rectangular slot structure, forming an elastic deformation space; a clamping platform 331 is disposed on an inner wall of the locking plate 330; the lock ring opening 322 is formed on a horizontal plane on which the clamping platform 331 is located; an opening flaring portion 332 is disposed at a lower part of the clamping platform 331; the opening flaring portion 332 forms an opening flaring chamber 323. The above structural design is optimized, wherein the upper disk 300 and the lock slot 310 are integrally formed, are preferably made from a plastic material, and have a good elastic effect; the structural design of the elastic slot 340 is optimized, facilitating the deformation, outward extension and retraction of the lock ring opening 322 formed on the clamping platform 331. Preferably, the structural design of the opening flaring portion 332 is optimized to form an opening flaring chamber 323, facilitating the abutment of the lock bar 500.

In combination with the above description, in another embodiment, the number of the locking plates 331 is preferably three, four, five, or six, and the most preferably is four.

Embodiment 2

Figure 13:
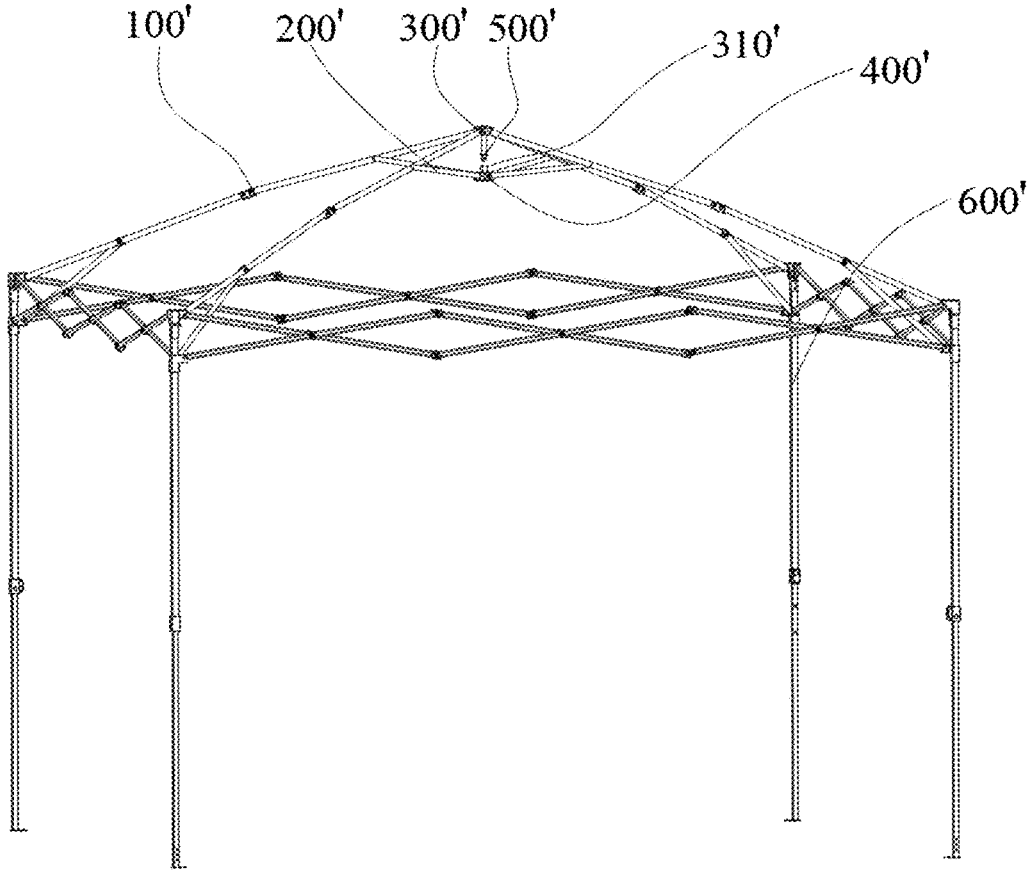
FIG. 13 is a schematic view of an overall structure of the present invention.
Figure 14:
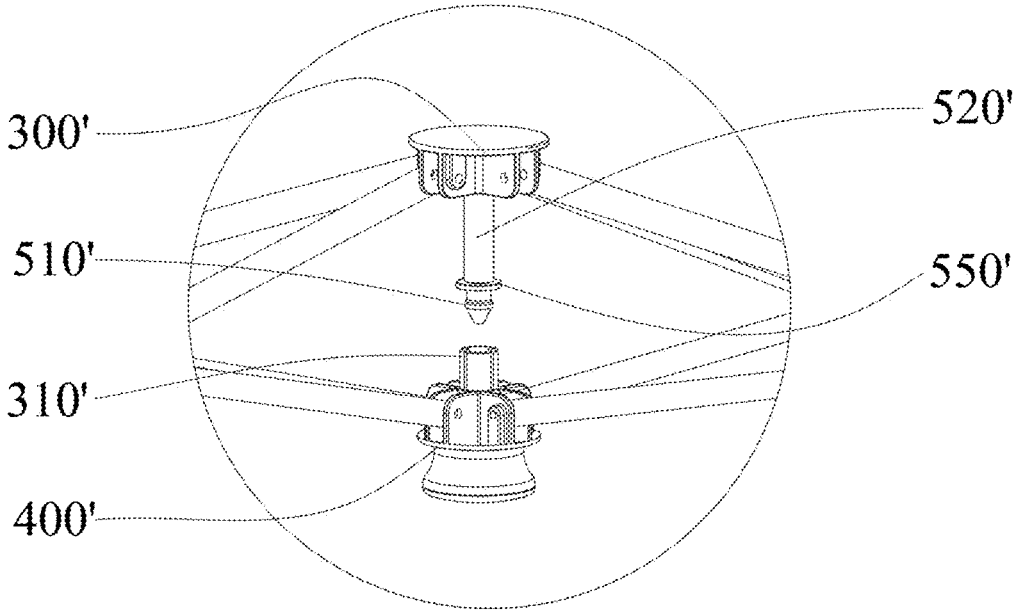
FIG. 14 is a second structural schematic view of the central locking mechanism in the unlocked state according to the present invention.
Figure 15:
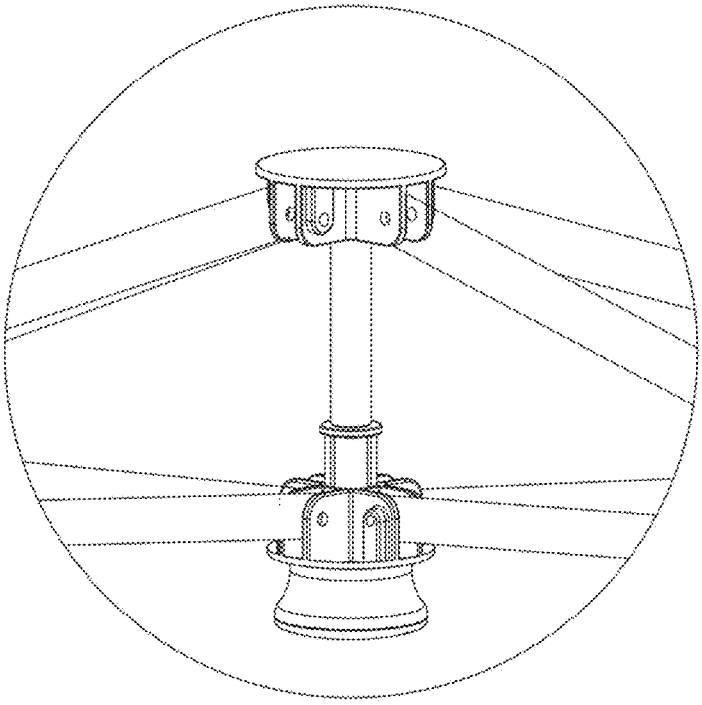
FIG. 15 is a second structural schematic view of the central locking mechanism in the locked state according to the present invention.
Figure 16:
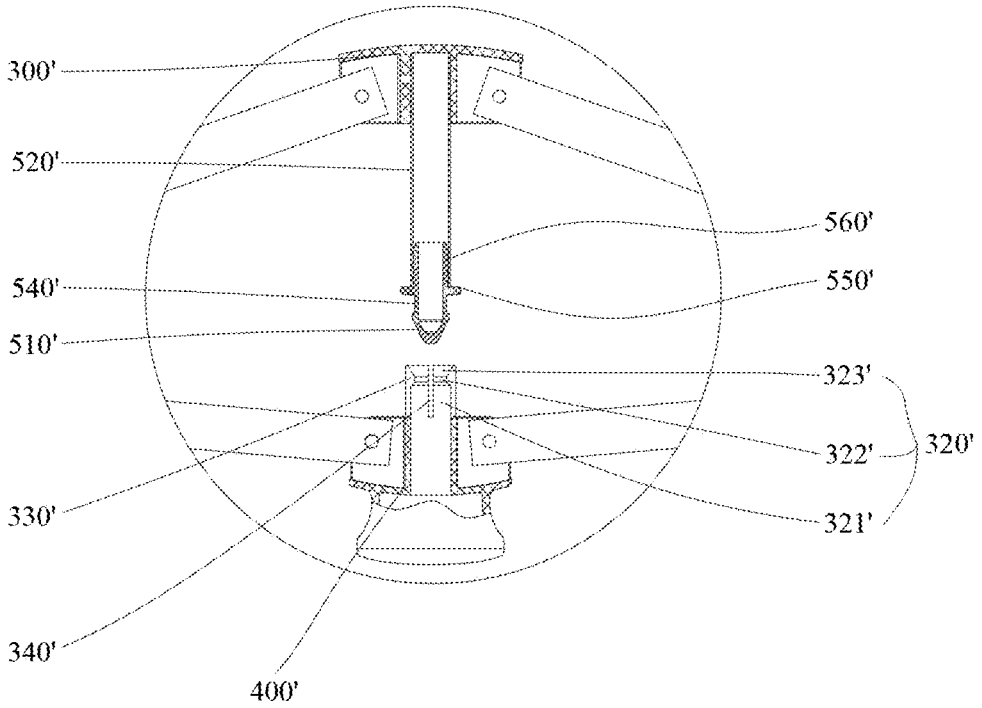
FIG. 16 is a second sectional structural schematic view of the central locking mechanism in the unlocked state according to the present invention.
Figure 17:
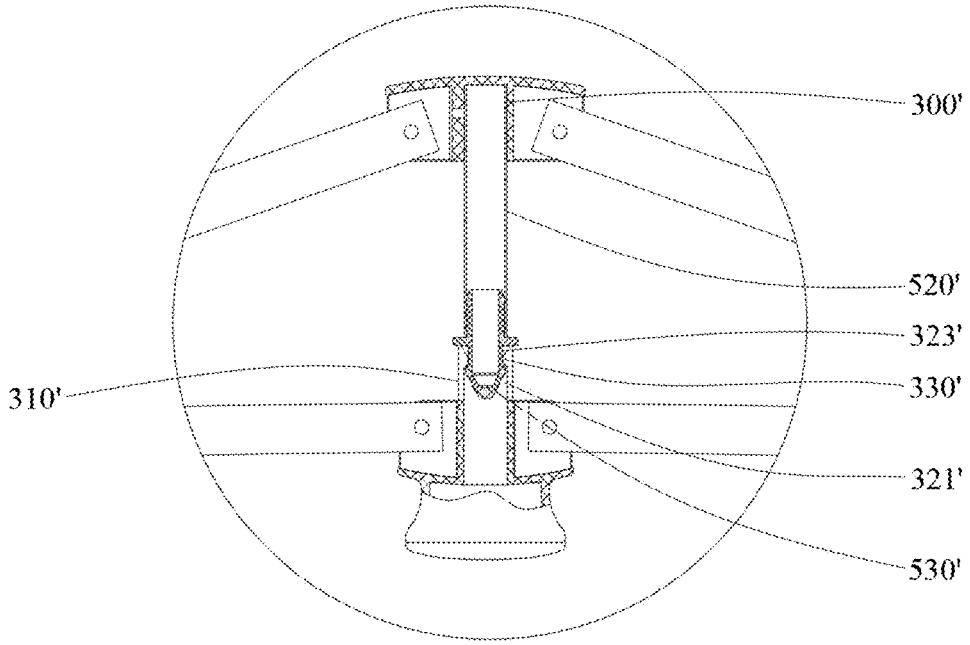
FIG. 17 is a second sectional structural schematic view of the central locking mechanism in the locked state according to the present invention.
Figure 18:
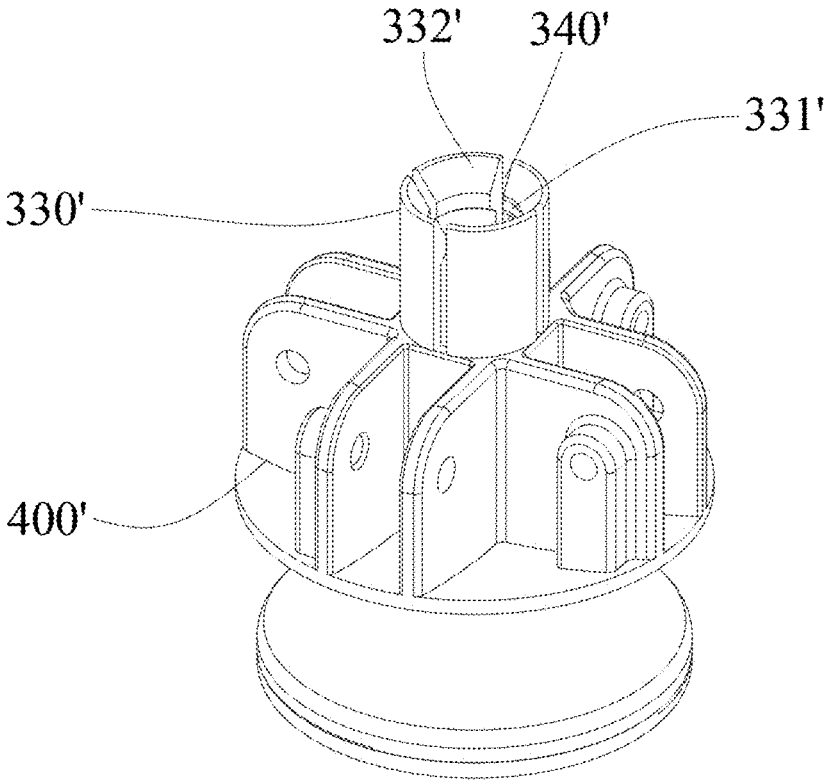
FIG. 18 is a schematic view of an overall structure of a lower disk according to the present invention.
Figure 19:
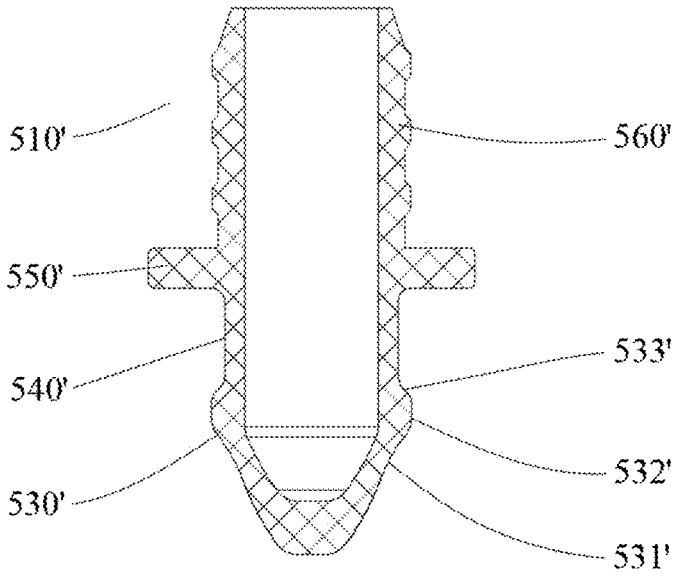
FIG. 19 is a second sectional structural schematic view of the lock head according to the present invention.

On the basis of embodiment 1, as shown in FIGS. 13-19, the present embodiment discloses a novel central locking mechanism for a folding tent, the folding tent including a tent roof frame and a central locking mechanism disposed on the tent roof frame; the central locking mechanism includes an upper disk 300' and a lower disk 400'; the upper disk 300' is cooperatively hinged to a plurality of long tent ribs 100'; the other ends of the long tent ribs 100' are cooperatively hinged to a leg pipe 600'; one long tent rib 100' generally consists of a plurality of cooperatively hinged tent ribs; a plurality of short tent ribs 200' are cooperatively disposed on the lower disk 400'; and the other ends of the short tent ribs 200' are cooperatively hinged to the long tent ribs 100. In the entire central locking mechanism, the lower disk 400' and the upper disk 300' movably cooperate; and the short tent ribs 200' support and drive the long tent ribs 100', so as to unfold and fold the entire folding tent.

Compared with the structure in embodiment 1, the positions of the lock bar 500' and the lock slot 310' are exchangeable; the lock bar 500' is located in the upper disk 300', and is disposed downwards; the lock slot 310' is located in the lower disk 400', and is disposed with an opening upwards; a lower end of the lock bar 500' is fastened in the lock slot 310' to complete locking. Preferably, the lock bar 500' includes a bar body 520' and a lock head 510' located at a lower end of the bar body 520'; an upper end of the bar body 520' is fixedly cooperated with the upper disk 300'; the lock head 510' is fixedly mounted at the lower end of the bar body 520'; the lock head 510' is fastened in the lock slot 310' to complete locking.

In combination with the above description, in the present embodiment, the structure of the lock head is optimized; the fastening structure of the lock head 510' and the lock slot 310' may be used to lock and limit the upper disk 300' and the lower disk 400', thus facilitating the locking of the unfolded folding tent.

Preferably, the lock head 510' includes a guide cone head 530', a limit post 540', and a limit ring platform 550'; the guide cone head 530' is completely fastened in the lock slot 310'; the limit ring platform 550' is in limit cooperation with a port of the lock slot 310'; the guide cone head 530' includes a guide cone portion 531', a detent portion 532', and an inverted cone portion 533'; a lock slot chamber 320' is disposed in the lock slot 310'; the lock slot chamber 320' sequentially includes a cone head accommodation chamber 321', a lock ring opening 322', and an opening flaring chamber 323' from top to bottom; an inner diameter size of the lock ring opening 322' is less than an outer diameter size of the detent portion 532'; and when the central locking mechanism is in a locked state, the guide cone head 530' is located in the cone head accommodation chamber 321'.

In specific use, when the folding tent changes from a folded state to an unfolded state, the lower disk 400' gradually gets close to the upper disk 300', the guide cone head 530' gradually moves downwards from the opening flaring chamber 323', and a conical surface of the guide cone head 530' presses against an inner wall of the opening flaring chamber 323'; after the lower disk 400' persistently moves upwards, the inner wall of the opening flaring chamber 323' is constantly squeezed by the conical surface of the guide cone head 530', and then persistently deforms, so as to drive the lower lock ring opening 322' to deform and extend outwards. The structure of the guide cone head 530' is optimized; the structural design of a conical wall is adopted to achieve a guide effect; when the guide cone head 530' moves upwards with the lower disk 400', the guide cone head presses against the lock ring opening 322'; with the persistent downward movement, the lock ring opening 322' also persistently extends outwards, until the detent portion 532' presses against the lock ring opening 322', and forcedly passes through the lock ring opening 322', so as to penetrate through the detent portion 532'; the lock ring opening 322' is not pressed by an external force, and therefore retracts; and the limit post 540' is filled in the lock ring opening 322'. Preferably, when no external force is applied to the lock ring opening 322', the inner diameter size is the same as or slightly greater than the outer diameter size of the limit post 540'; the inverted cone portion 533' is in a transition region between the limit post 540' and the detent portion 532'; the retracted lock ring opening 322' limits the inverted cone portion 533'; the design of the inverted cone portion is optimized, facilitating the outward extension and disengagement of the lock ring opening 322' during unlocking.

In combination with the above description, in one embodiment, the lock head 510' and the lock bar 520' are of an integrated structure, namely are integrally formed.

In combination with the above description, in one embodiment, the lock head 510' and the lock bar 520' adopt a split fixed structure, wherein the lock head 510' further includes an embedded portion 560'; the embedded portion 560' is located at an upper part of the limit ring platform 550', and is fixedly cooperated with the lower end of the bar body 520'; the lock head 510' adopts a detachable structure, wherein the lock head 510' is preferably made from a plastic material; the bar body 520' is preferably made from a metal material; the lock head 510' is integrally formed by means of injection molding, thus simplifying the components and reducing the cost.

In combination with the above description, preferably, the lock slot 310' includes at least two locking plates 330'; the locking plates 330' mutually form a lock slot chamber 320'; an elastic slot 340' is disposed between two adjacent locking plates 330'; the elastic slot 340' is an isosceles trapezoid; an upper end surface of the elastic slot 340' is larger than a lower end surface; a clamping platform 331' is disposed on an inner wall of the locking plate 330'; the lock ring opening 322' is formed on a horizontal plane on which the clamping platform 331' is located; an opening flaring portion 332' is disposed at an upper part of the clamping platform 331'; the opening flaring portion 332' forms an opening flaring chamber 323'. The above structural design is optimized, wherein the lower disk 400' and the lock slot 310' are integrally formed, are preferably made from a plastic material, and have a good elastic effect; the structural design of the elastic slot 340' is optimized, facilitating the deformation, outward extension and retraction of the lock ring opening 322' formed on the clamping platform 3311. Preferably, the structural design of the opening flaring portion 332' is optimized to form an opening flaring chamber 323', facilitating the abutment of the lock bar 500'.

In combination with the above description, in another embodiment, the number of the locking plates 331' is preferably three, four, five, or six, and the most preferably is four.

Embodiment 3

On the basis of any one of the above embodiments, the present invention discloses a folding tent, using the central locking mechanism in embodiment 1 or embodiment 2, wherein the central locking mechanism may be applied to the folding tents in other standards, such as a single-roof folding tent, a double-roof folding tent, a multi-roof folding tent and the like.

The present invention optimizes the structure of the central locking mechanism, may realize push-up self-locking and pull-down unlocking by means of the fastening cooperation of the lock bar and the lock slot, thus facilitating locking and unlocking operations. In addition, the lock bar and the lock slot have simple structures; especially, the upper disk and the lock slot may be integrally injection-molded, thus reducing the manufacturing cost of the product.

The descriptions above are only preferred embodiments of the present invention, but not intended to limit the present invention in any form; and any simple amendments, equivalent variations and modifications made to the above embodiments on the basis of the technical principle of the present invention shall still be concluded in the scope of protection of the technical solution of the present invention.

What is claimed is:

1. A central locking mechanism for a folding tent, the folding tent comprising a tent roof frame and a central locking mechanism disposed on the tent roof frame; the central locking mechanism comprising:

an upper disk;

a lower disk;

a lock bar cooperatively disposed on the lower disk; and a lock slot disposed at a lower part of the upper disk and comprising a lower edge;

wherein the lock bar comprises a bar body and a lock head that is fixedly attached to an upper end of the bar body; a lower end of the bar body is fixedly cooperated with the lower disk; the lock head comprises a guide cone head, a limit post, and a limit ring platform larger than the lower edge of the lock slot; and wherein when the central locking mechanism is in a locking position, the guide cone head is completely fastened in the lock slot, and the limit ring platform leans against the lower edge of the lock slot.

2. The central locking mechanism for a folding tent according to claim 1, wherein the lock head and the bar body are of an integrated structure.

3. The central locking mechanism for a folding tent according to claim 1, wherein the lock head further comprises an embedded portion; the embedded portion is located at a lower part of the limit ring platform, and is fixedly cooperated with the upper end of the bar body.

4. The central locking mechanism for a folding tent according to claim 1, wherein the guide cone head comprises a guide cone portion, a detent portion, and an inverted cone portion; a lock slot chamber is disposed in the lock slot; the lock slot chamber sequentially comprises a cone head accommodation chamber, a lock ring opening, and an opening flaring chamber from top to bottom; an inner diameter size of the lock ring opening is less than an outer diameter size of the detent portion; and when the central locking mechanism is in a locked state, the guide cone head is located in the cone head accommodation chamber.

5. The central locking mechanism for a folding tent according to claim 4, wherein when the folding tent changes from a folded state to an unfolded state, the lower disk gradually gets close to the upper disk, and the guide cone head gradually move upwards from the opening flaring chamber, such that the lock ring opening deforms and extends outwards to penetrate through the detent portion, and the lock ring opening retracts and limits the inverted cone portion.

6. The central locking mechanism for a folding tent according to claim 1, wherein the lock slot comprises at least two locking plates; the locking plates mutually form a lock slot chamber; an elastic slot is disposed between two adjacent locking plates; and a clamping platform is disposed on an inner wall of the locking plate.

7. The central locking mechanism for a folding tent according to claim 6, wherein the lock ring opening is formed on a horizontal plane on which the clamping platform is located; an opening flaring portion is disposed at a lower part of the clamping platform; the elastic slot is an isosceles trapezoid; an upper end surface of the elastic slot is smaller than a lower end surface.

8. The central locking mechanism for a folding tent according to claim 6, wherein the number of the locking plates is three, four, five, or six.

9. A folding tent, comprising the central locking mechanism according to claim 1.

10. A novel central locking mechanism for a folding tent, the folding tent comprising a tent roof frame and a central locking mechanism disposed on the tent roof frame; the central locking mechanism comprising:

an upper disk;

a lower disk;

a lock bar located in one of the upper disk and the lower disk;

a lock slot located in the other of the upper disk and the lower disk and comprising an edge, wherein the lock bar comprises a bar body and a lock head fixedly attached to one end of the bar body; the other end of the bar body is fixedly cooperated with the one of the upper disk and the lower disk; the lock head comprises a guide cone head, a limit post, and a limit ring platform larger than the edge of the lock slot; and wherein when the novel central locking mechanism is in a locking position, the guide cone head is completely fastened in the lock slot, and the limit ring platform leans against the edge of the lock slot.

11. The novel central locking mechanism for a folding tent according to claim 10, wherein the lock head and the bar body are of an integrated structure.

12. The novel central locking mechanism for a folding tent according to claim 10, wherein the lock head further comprises an embedded portion disposed at a part of the limit ring platform that faces away from the guide cone head the embedded portion being fixedly cooperated with the one end of the bar body.

13. The novel central locking mechanism for a folding tent according to claim 10, wherein the guide cone head comprises a guide cone portion, a detent portion, and an inverted cone portion; a lock slot chamber is disposed in the lock slot; the lock slot chamber sequentially comprises a cone head accommodation chamber, a lock ring opening, and an opening flaring chamber from bottom to top; an inner diameter size of the lock ring opening is less than an outer diameter size of the detent portion; and when the central locking mechanism is in a locked state, the guide cone head is located in the cone head accommodation chamber.

14. The novel central locking mechanism for a folding tent according to claim 13, wherein when the folding tent changes from a folded state to an unfolded state, the lower disk gradually gets close to the upper disk, and the guide cone head gradually move away from the opening flaring chamber, such that the lock ring opening deforms and extends outwards to penetrate through the detent portion, and the lock ring opening retracts and limits the inverted cone portion.

15. The novel central locking mechanism for a folding tent according to claim 10, wherein the lock slot comprises at least two locking plates; the locking plates mutually form a lock slot chamber; an elastic slot is disposed between two adjacent locking plates; and a clamping platform is disposed on an inner wall of the locking plate.

16. The novel central locking mechanism for a folding tent according to claim 15, wherein the lock ring opening is formed on a horizontal plane on which the clamping platform is located; an opening flaring portion is disposed at a lower part of the clamping platform; the elastic slot is an isosceles trapezoid; an upper end surface of the elastic slot is larger than a lower end surface.

17. The novel central locking mechanism for a folding tent according to claim 15, wherein the number of the locking plates is three, four, five, or six.

18. A folding tent comprising the central locking mechanism according to claim 10.

* * * * *